US007735481B1

(12) United States Patent
Kalsi et al.

(10) Patent No.: US 7,735,481 B1
(45) Date of Patent: Jun. 15, 2010

(54) OVEN RACK HAVING HINGED ROLLERS

(75) Inventors: Surjit S. Kalsi, Rancho Palos Verdes, CA (US); Rafael H. Romero, Downey, CA (US); Surya Kanwal Kalsi, Huntington Beach, CA (US); Roberto Bernal, Rancho Palos Verdes, CA (US)

(73) Assignee: Capital Cooking Equipment, Inc., Sante Fe Springs, CA (US)

( * ) Notice: Subject to any disclaimer, the term of this patent is extended or adjusted under 35 U.S.C. 154(b) by 0 days.

(21) Appl. No.: 11/840,899

(22) Filed: Aug. 17, 2007

(51) Int. Cl.
*F24C 15/16* (2006.01)

(52) U.S. Cl. ..... 126/337 R; 126/332; 126/339; 126/333; 211/69.6; 211/80; 211/166; 108/115; 108/147.11

(58) Field of Classification Search ..... 126/337 R, 126/332, 339, 333; 312/306, 311; 211/81, 211/90.02, 90.03, 98, 69.6, 80, 97, 101–103, 211/116, 150, 117, 151, 83, 166, 173, 174, 211/170, 187; 108/115, 147.11; 134/56 D
See application file for complete search history.

(56) References Cited

U.S. PATENT DOCUMENTS 2,420,173 A * 5/1947 Hall ..... 211/153
2,609,267 A * 9/1952 Hallock ..... 312/306
2,787,381 A * 4/1957 Hallock ..... 312/311
2,804,068 A * 8/1957 Miller et al. ..... 126/337 R
3,990,756 A * 11/1976 Han ..... 312/311
4,138,175 A * 2/1979 Tattershall ..... 312/408
5,507,398 A * 4/1996 Miller ..... 211/153
D425,754 S * 5/2000 Matteson et al. ..... D7/409
7,455,066 B2 * 11/2008 Feddema et al. ..... 134/56 D
2006/0250058 A1 * 11/2006 Stevens et al. ..... 312/311

* cited by examiner

*Primary Examiner*—Steven B McAllister
*Assistant Examiner*—Avinash Savani
(74) *Attorney, Agent, or Firm*—Jerry Turner Sewell

(57) ABSTRACT

An oven includes an oven cavity having multiple pairs of horizontally disposed guide slots recessed into the side walls of the oven cavity. At least one oven rack is configured with at least two wheels mounted on axles secured to at least one hinged support along an edge of the oven rack. After the oven rack is inserted into the oven cavity, the hinged support is pivoted to move the axles of the wheels to a generally horizontal position to cause the wheels to engage the horizontal slots and support the oven rack. The oven rack is removed from the oven cavity by lifting the oven rack to cause the wheels to disengage from the horizontal guide slots and to pivot so that the axles are at an angle with respect to the horizontal position. With the wheels disengaged from the guide slots, the oven rack is readily removable from the oven cavity.

15 Claims, 8 Drawing Sheets

OVEN RACK HAVING HINGED ROLLERS

BACKGROUND OF THE INVENTION

1. Field of the Invention

The present invention is generally in the field of cooking appliances, and, more particularly, is in the field of ovens having removable racks for supporting cookware.

2. Description of the Related Art

Typical ovens comprise an insulated oven cavity or box that is accessible by a door that enables a user to place cookware on one or more racks within the cavity. Generally, the oven racks are removable and are positionable within the cavity at a plurality of levels. The oven racks usually slide in and out of the oven so that cookware can be positioned on an extended rack and then pushed into the oven cavity on the oven rack instead of requiring the user to place his or her hands within the oven cavity and risk injury from hot components within the cavity.

A conventional oven rack comprises a sturdy frame of rod-shaped material having a plurality of smaller rod-shaped elements supported by the frame. The smaller rod-shaped elements are spaced apart by a selected distance in order to provide sufficient support for cookware placed on the oven rack while permitting conductive and convective heat to easily pass between the elements. Typical oven racks comprise stainless steel or other suitable material that is able to withstand the high temperatures within the oven cavity.

Generally, an oven rack and the oven into which it is placed are configured so that the sides of the oven rack frame rest on ledges positioned on opposing sides of the oven cavity and extending into the cavity. When the oven rack is moved with a cookware positioned on the oven rack, the oven rack may be difficult to move because of friction between the frame of the oven rack and the ledges. The lower edges of the sides of the oven rack include protrusions that engage indents in the ledges or gaps between segments of the ledges so that the oven rack may be retained in the fully inserted position and restrained in a partially extended position. The user must first lift the oven rack to disengage the protrusions from the indents or gaps in order to move the oven rack from one of the positions to the other positions.

Various configurations of oven racks and oven cavities have been tried to provide an oven rack that has reduced friction. For example, the oven rack or the oven may be configured with bearings to eliminate the sliding friction. Such configurations generally include a guide rail (or other contrivance) along the side of the oven. Such guide rails or other contrivances extend further into the oven. Furthermore, the guide rails or other contrivances include surfaces with tight corners that collect grease and other food particles that must be cleaned periodically. Such cleaning is difficult and is not always effective.

SUMMARY OF THE INVENTION

An aspect of embodiments in accordance with the present invention is an oven rack having a pair of roller bearings in opposing sides. The oven rack is configured to be releasably engagable with a pair of horizontal guides on opposing side walls of an oven cavity. In the illustrated preferred embodiment, the roller bearings on each side of the oven rack are secured to respective hinged roller bearing supports. The roller bearings are pivoted to a support position with the roller bearings extended outward from the frame and inserted in the horizontal guides. The outer surfaces of the roller bearings roll within the horizontal guides as the oven rack is moved from an extended position to a fully inserted position. When the oven rack is lifted within the oven cavity, the hinged roller bearing supports automatically pivot to a dropped position to disengage the roller bearings from the horizontal guides so that the oven rack can be easily removed from the oven cavity. The horizontal guides are formed as recesses within the walls of the oven cavity so that no portions of the horizontal guides extend into the oven cavity. The horizontal guides have a generally rectangular profile and are readily accessible for cleaning.

BRIEF DESCRIPTION OF THE DRAWINGS

The foregoing aspects and other aspects of this disclosure are described in detail below in connection with the accompanying drawing figures in which.

DETAILED DESCRIPTION OF A PREFERRED EMBODIMENT

Figure 1:
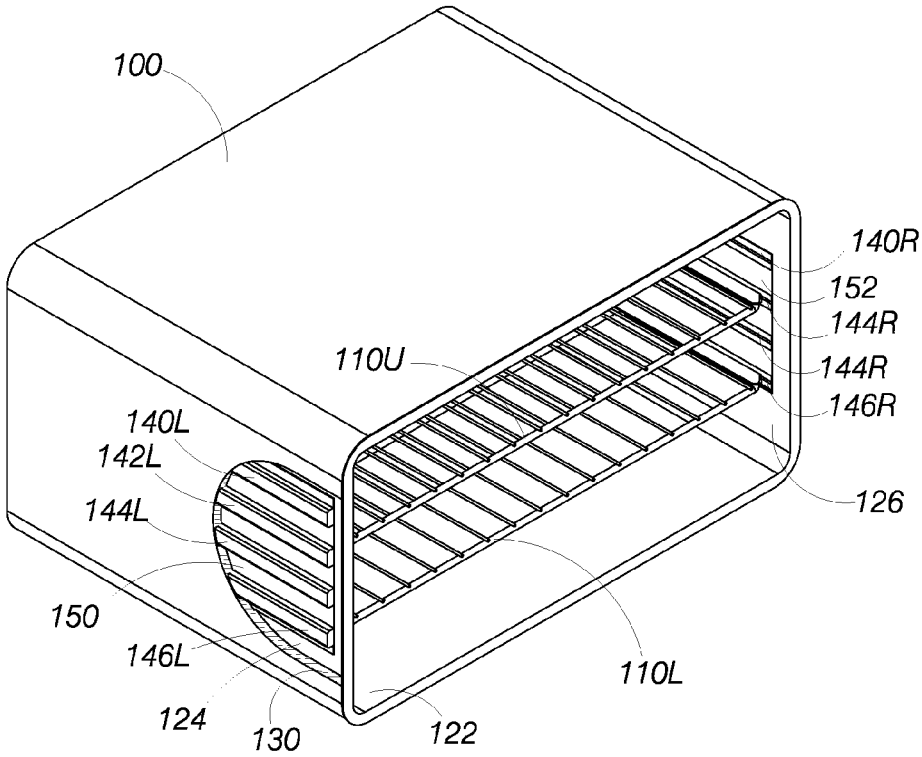
FIG. 1 illustrates a perspective view of an oven cavity with a lower oven rack and an upper oven rack inserted in respective pairs of horizontal guide slots formed in the sides of the oven cavity.
Figure 2:
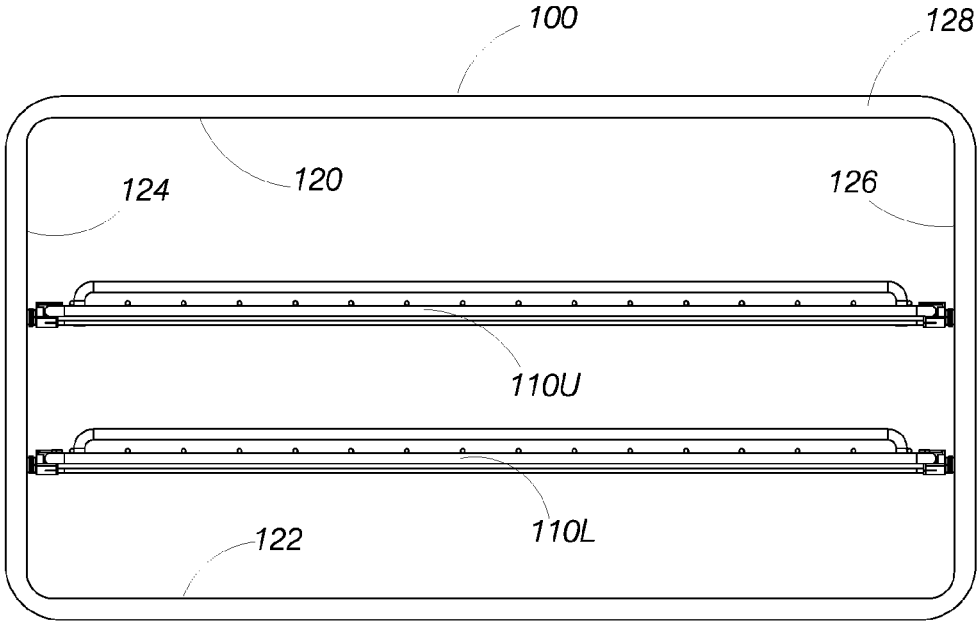
FIG. 2 illustrates a front elevation view of the oven cavity and the oven racks of FIG. 1.

FIGS. 1-8 illustrates an oven cavity 100 and a plurality of oven racks 110 (shown as an upper oven rack 110U and a lower oven rack 110L) in accordance with an exemplary embodiment. Only the shell of the oven cavity is shown in the drawings. One skilled in the art will appreciate that when the oven cavity is installed in a range (not shown) or is built into a kitchen cabinet or the like, the oven cavity will include a door (not shown), gas or electric heating elements (not shown) and other accessory equipment (not shown). Such additional structures are not necessary for understanding the description herein, which is related to the internal structure of the oven cavity and the structure of the oven racks.

The oven cavity 100 comprises an upper wall 120, a lower wall 122, a left side wall 124 and a right side wall 126. The oven cavity preferably comprises steel having a thickness of approximately 0.005 inch. At least the inner surfaces of the oven cavity are coated with a glazed layer of conventional high temperature porcelain enamel that is able to withstand the high temperatures in the oven cavity when preparing food and when cleaning the oven. The open front of the oven cavity is surrounded by a mounting flange 128. The oven cavity also includes a back wall (not shown), which may include additional structures (not shown), such as, for example, an illumination device (e.g., a light). As shown in FIG. 1 only, the walls of the oven cavity are surrounded by a layer 130 of a suitable insulation material (shown in partial broken section). The insulation material is conventional and is not shown in the other drawings. The back wall (not shown) is also advantageously insulated in a suitable manner.

Each oven rack 110 is positionable in the oven cavity 100 in one of four locations as defined by four pairs of horizontal left and right guide slots 140L, 140R; 142L, 142R; 144L, 144R; 146L, 146R. The two guide slots in each pair of guide slots are positioned on the opposing side walls 124, 126 of the oven cavity. As shown in the front elevation view in FIG. 2, the guide slots are recessed in the side walls so that no portion of a guide slot extends into the oven cavity.

In FIG. 1, both oven racks 110 are shown fully inserted into the oven cavity 100. When fully inserted, the oven racks function as cooking platforms to support cookware and to allow the heat generated by the heating elements to flow between the open portions of the oven racks to fully surround the cookware.

Figure 3:
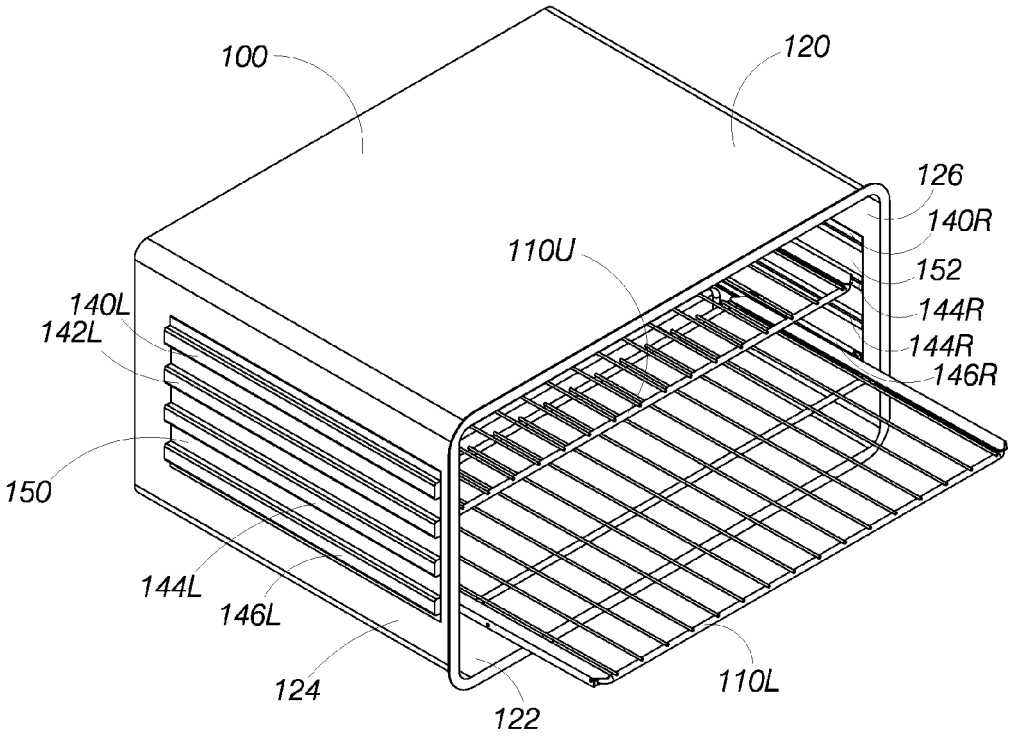
FIG. 3 illustrates a perspective view of the oven cavity and the oven racks of FIG. 1 with the lower oven rack partially extended from the oven cavity.

As shown in FIG. 3 for the lower oven rack 110L, either oven rack may be partially extended from the oven cavity 100 to allow a user to place cookware on or remove cookware from the oven rack without removing the oven rack completely from the oven cavity. As will be described below, the oven cavity and the oven racks are configured to provide a positive stopping position for each oven rack when partially extended.

Figure 4:
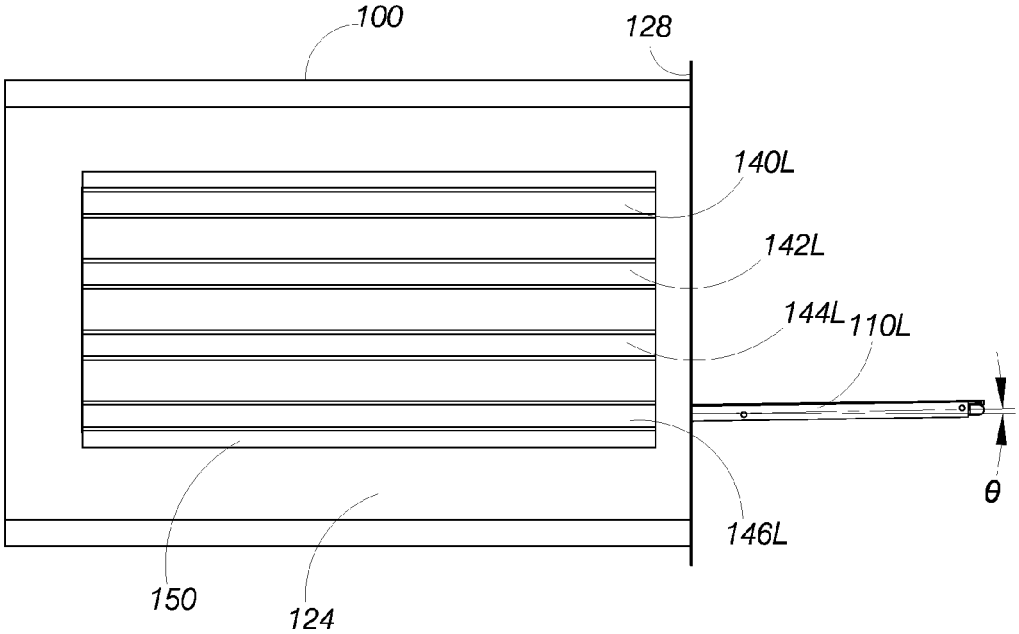
FIG. 4 illustrates side elevation view of the oven cavity and the extended lower oven rack of FIG. 3.

As shown in the side elevation view of FIG. 4 for the extended lower oven rack 110L, the cooking platform provided by each oven rack is not horizontal. Rather, the front of the cooking platform is raised by a small angle (designated as θ in FIG. 4) to reduce any tendency of cookware to slide towards the front of the oven rack if the oven rack is inserted into the oven cavity 100 with excessive acceleration. For example, in the illustrated embodiment, θ is approximately 0.9 degree.

Although the oven cavity 100 and the oven racks 110 appear to function in a conventional manner, the structures of the oven cavity and the oven racks are uniquely configured to reduce the effort needed to install and remove the oven racks and to clean the oven cavity. As discussed above, the guide slots 140L, 140R; 142L, 142R; 144L, 144R; 146L, 146R do not protrude into the oven cavity. Rather, as shown in more detail in FIGS. 5 and 6, the guide slots are formed as horizontal depressions with respect to the left wall 124 and the right wall 126. In the illustrated embodiment, the guide slots are formed on a left guide slot panel 150 and a right guide slot panel 152, which are mirror images of each other. The left guide slot panel is sized to fit in a generally rectangular opening 160 in the left side wall of the oven cavity. The right guide slot panel is sized to fit in a generally rectangular opening 162 in the right side wall of the oven cavity. Each rectangular opening has a height of approximately 7.44 inches and has a length of approximately 17.35 inches. The front of each rectangular opening is displaced from the rear of the flange 128 by approximately 1.11 inches. When positioned in the rectangular openings, the two guide slot panels are aligned so that the respective pairs of guide slots on each side wall are horizontally aligned.

Each of the panels 150, 152 comprises a steel sheet having a thickness of approximately 0.05 inch and length (L) of approximately 17.33 inches, which is slightly less than the length of the openings 160, 162 in the side walls 124, 126 of the oven cavity 100. The four guide slots 140L, 142L, 144L, 146L in the left panel and the four guide slots 140R, 142R, 144R, 146R in the right panel are formed by bending the steel sheet into the illustrated shape. As shown more clearly in the enlarged cross-sectional view of FIG. 6 for the right panel, each guide slot comprises a recess having a depth (D) of approximately 0.41 inch with respect to a panel face 170. The panel face is mounted flush with the respective inner wall (e.g., the right wall) of the oven cavity when the right panel is inserted into the right rectangular opening.

Figure 6:
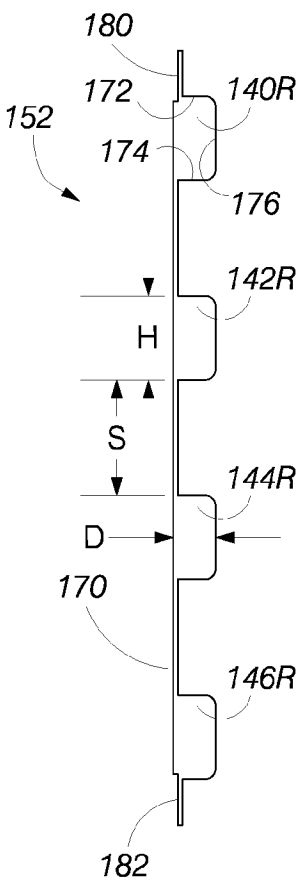
FIG. 6 illustrates an enlarged cross-sectional front elevation view of the right guide slot panel taken along the line 6-6 in FIG. 5.
Figure 5:
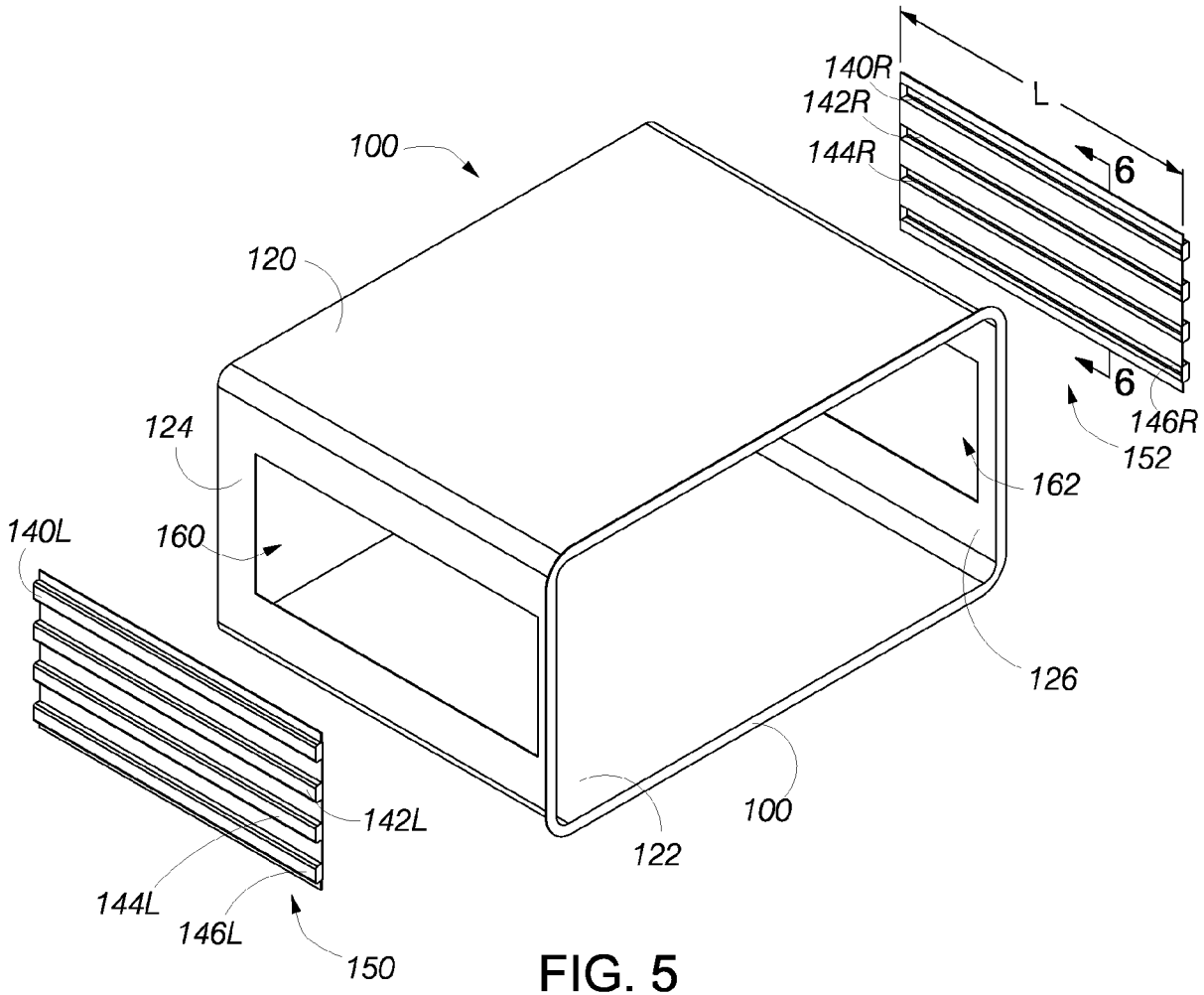
FIG. 5 illustrates an exploded perspective view of the oven cavity and the two panels that form the guide slots for the oven racks.

As illustrated for the uppermost guide slot 140R in FIG. 6, each guide slot has a lower horizontal surface 172, an upper horizontal surface 174 and a vertical rear surface 176. The horizontal surfaces and the rear surface are interconnected with fillets having inside radii of approximately 1/16 inch (0.0625 inch). Each guide slot has a vertical height (H) of approximately 0.8 inch and has a length of approximately 17.3 inches, which corresponds to the length of the rectangular openings 160, 162. The guide slots are spaced apart along the panel face 170 by a vertical spacing distance (S) of approximately 1.35 inches to provide a center-to-center spacing between the guide slots of approximately 2.15 inches. The forward and rear ends of each guide slot are closed by welding an end piece at each end of the right guide slot panel 152 either before attaching the guide slot panel to the right oven wall 126 or after attaching the panel. The ends of the guide slots in the left guide slot panel 150 are closed in a similar manner. The generally rectangular profiles of the guide slots with a vertical height greater than the recess depth cause the guide slots to be easily accessible for thorough cleaning.

As illustrated for the right guide slot panel 152, each panel has an upper flange 180 and a lower flange 182. The two flanges extend the overall height of the respective panel to approximately 8.34 inches. The two flanges are recessed by approximately 0.05 inch from the panel face 170 so that when the panel is inserted in the respective opening 160, 162 of the oven cavity 100 with the panel face flush with the respective inner surface of the wall of the oven cavity, each flange extends beyond the opening and rests upon the outer surface of the wall. The flanges function to accurately position the panel face and also to provide a welding surface to secure the panel to the outer surface of the oven cavity.

After forming the left guide slot panel 150 is welded to the left wall 124 and the right guide slot panel 152 is welded to the right wall 126 of the oven cavity 100, the inner surfaces of the oven cavity and the guide slot panels are coated with a glazed layer of conventional high temperature porcelain enamel that is able to withstand the high temperatures in the oven cavity when preparing food and when cleaning the oven.

Figure 7:
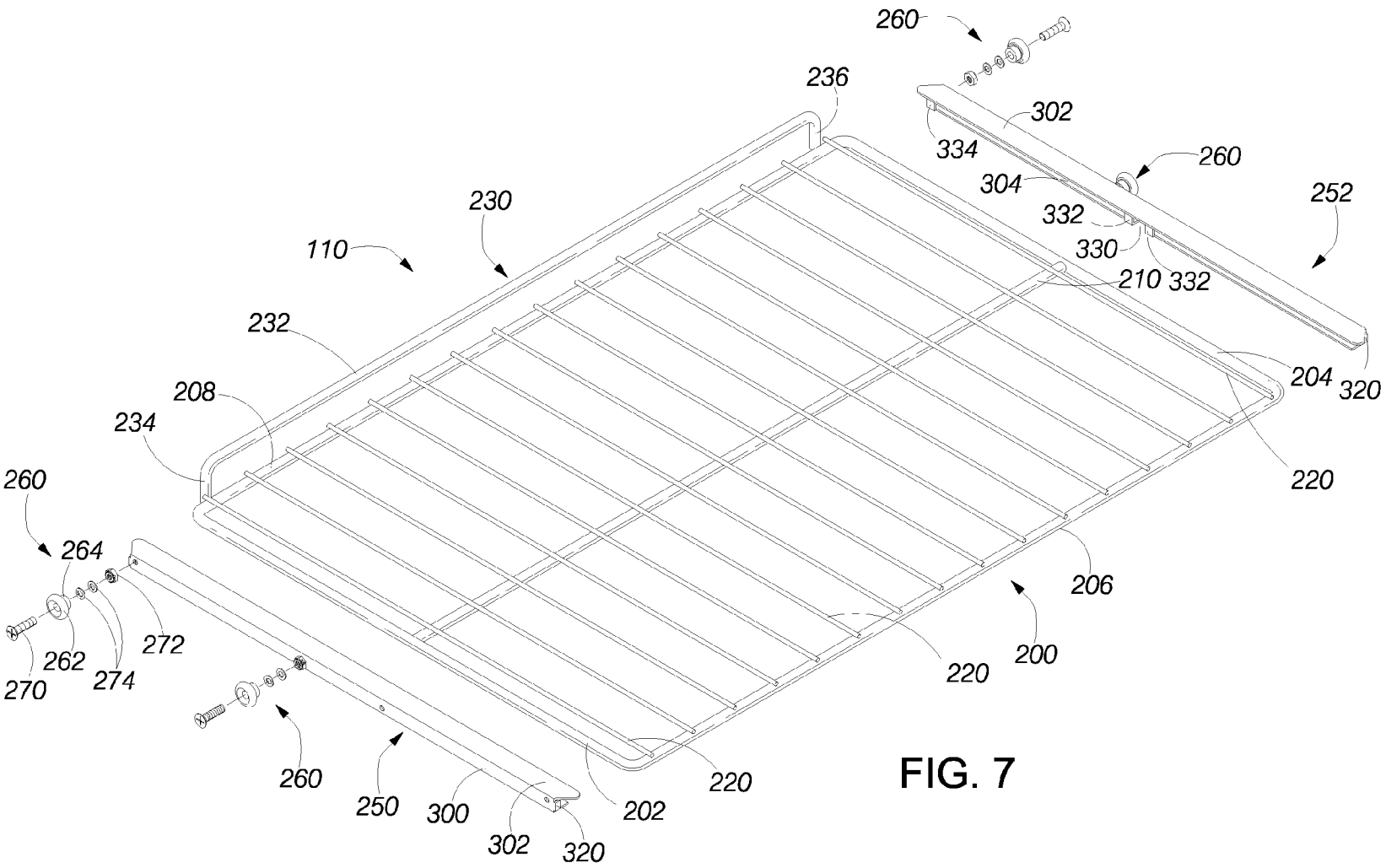
FIG. 7 illustrates an exploded perspective view of one of the oven racks of FIGS. 1-4.

FIG. 7 illustrates an exploded perspective view of the oven rack 110. The oven rack comprises a generally rectangular frame 200 that is advantageously formed of stainless steel rod having an outer diameter of approximately 5/16 inch (0.313 inch). The frame has a left frame member 202, a right frame member 204, a front frame member 206 and a rear frame member 208. The frame has a width of approximately 25.64 inches and a length of approximately 17.31 inches. In the illustrated embodiment, the corners of the frame between the frame members have radii of approximately 0.41 inch (measured with respect to the centerline of the rod forming the frame). The frame further includes a single stainless steel central frame member 210 of like outer diameter. The central frame member is positioned in the plane of the frame substantially midway between the front frame member and the rear frame member. The ends of the central frame member are welded to the left frame member and the right frame member.

The oven rack 110 further includes a plurality of cross rods 220 that extend from the front frame member 206, across the central frame member 210 to the rear frame member 208. The cross rods comprise stainless steel and have outer diameters of approximately 1/8 inch (0.125 inch). In the illustrated embodiment, the oven rack includes 16 cross rods that are spaced apart by approximately 1.625 inches (1 5/8 inches). The cross rods are secured to the front frame member, the rear frame member and the central frame member by welding.

The oven rack 110 further includes a rear fence 230 that also advantageously comprises stainless steel rod with an outer diameter corresponding to the outer diameters of the frame members 202, 204, 206, 208, 210. The rear fence is bent to form a horizontal fence member 232, a left vertical fence support member 234 and a right vertical fence support member 236. A lower portion of each vertical fence support member is welded to the rear frame member 208. The height of the vertical fence support members is selected so that the horizontal fence member has a height above the rear frame member of approximately 1 inch measured from the centerline of the horizontal fence member to the centerline of the rear frame member. The rear fence is centered on the rear frame member and has a width of approximately 24 inches measured between the centerlines of the rods forming the two vertical fence support members.

The oven rack 110 includes a left hinged roller bearing support 250 and a right hinged roller bearing support 252, that are pivotally attached to the left frame member 202 and the right frame member 204, respectively. Each roller bearing support is a base for a pair of roller bearing assemblies 260. Each roller bearing assembly comprises an outer wheel 262 that rotates about a fixed central hub 264. The roller bearing assembly includes a plurality of ball bearings (not shown) that are constrained between the central hub and an inner surface of the outer wheel. The central hub of each roller bearing assembly is mounted to the respective roller bearing support by an axle 270. The axle is threaded into a nut 272, which is welded to the roller bearing support in a position concentric to a positioning hole formed in the support, as described below. The nut advantageously includes an attached lock washer. The hub of each roller bearing assembly is spaced from the roller bearing support by one or more flat washers 274.

Figure 12:
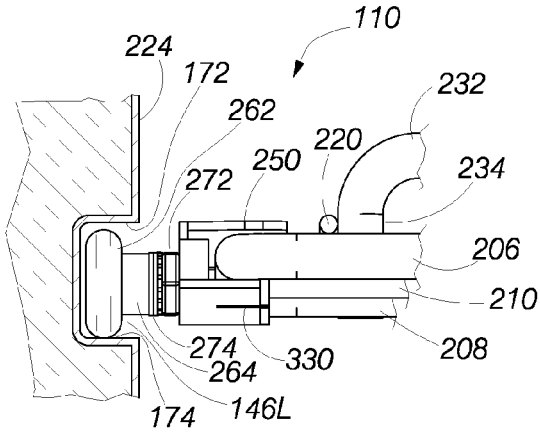
FIG. 12 illustrates an enlarged view of the left roller bearing and the left horizontal guide slot of the oven cavity in the area bounded by the arcuate line 12 in FIG. 11.

In the preferred embodiment, the roller bearing assembly 260 advantageously comprises a stainless steel ball bearing assembly having an extended inner hub such as, for example, the Model No. S26-Y001 ball bearing commercially available from Component Hardware Group, Inc., of Lakewood, N.J. The outer wheel 262 of the bearing assembly has an outside diameter of approximately 0.76 inch and has a thickness of approximately 0.25 inch. As shown in FIG. 12, for example, the engagement surface of the outer wheel has a semicircular profile. The axle 270 advantageously comprises a 10-32 machine screw with a flat head having dimensions that match a countersink in the hub 264 of the bearing assembly.

Figures 8, 9:
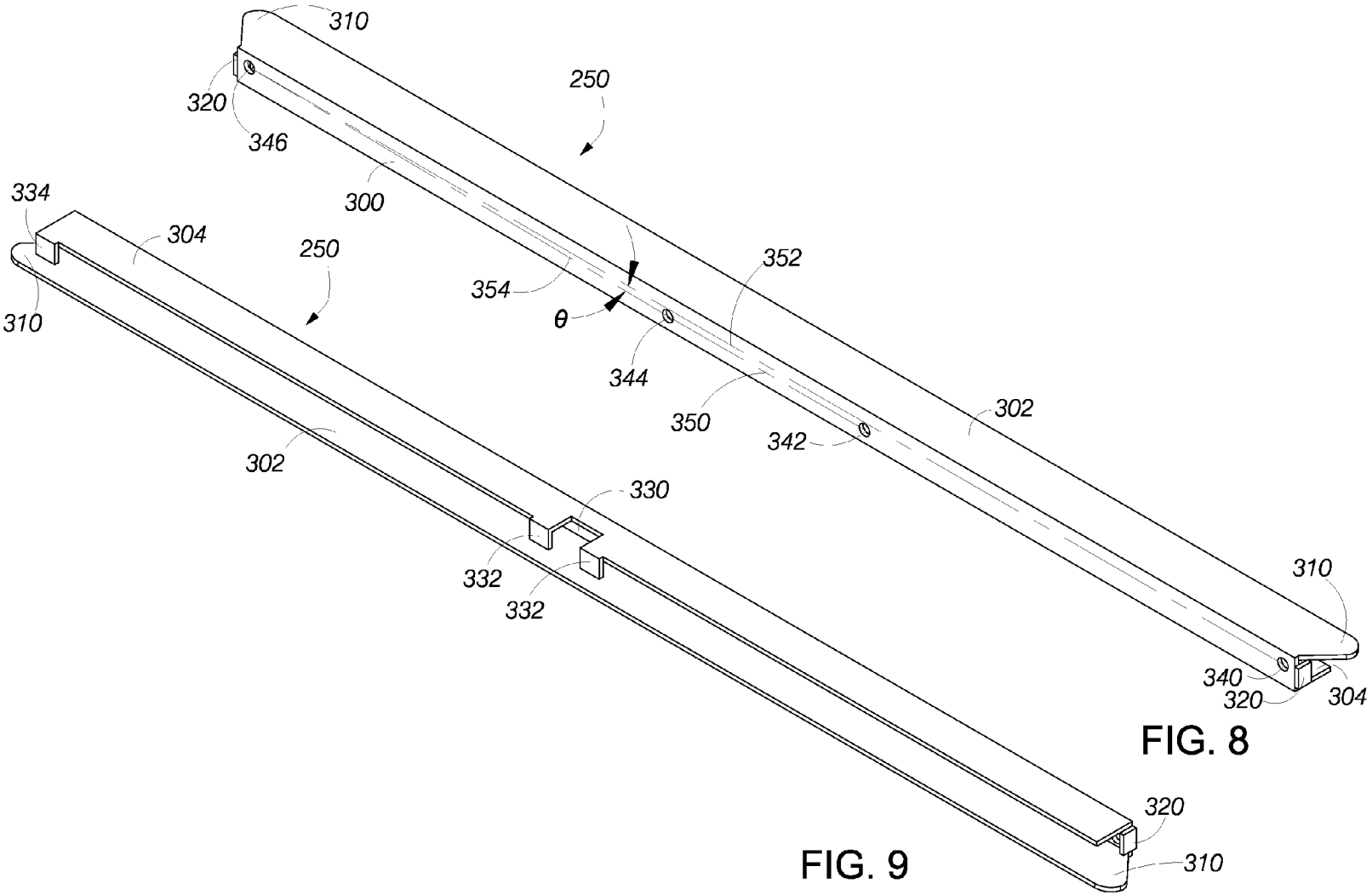
FIG. 8 illustrates an enlarged perspective view of the left hinged roller bearing support looking at the top of the support.
FIG. 9 illustrates an enlarged perspective view of the left hinged roller bearing support of FIG. 8 rotated about the longitudinal axis of the support to show the bottom of the support.

The left hinged roller bearing support 250 is illustrated in more detail in FIGS. 8 and 9. FIG. 8 is a top perspective view. FIG. 9 is a perspective view showing the left roller bearing support rotated by 180 degrees about a longitudinal axis to show the bottom of the roller bearing support. In the illustrated preferred embodiment, the right roller bearing support 252 is a mirror image of the left roller bearing support.

The left roller bearing support 250 comprises steel having a thickness of approximately 0.06 inch that is formed into a generally U-shaped profile having a left side wall 300, an upper wall 302 and a lower wall 304. The open portion of the U-shaped profile is positioned to the right in FIG. 8.

The left side wall 300 and the lower wall 304 are generally rectangular and have a length of approximately 16.66 inches. The left side wall has a height of approximately 0.34 inch. The lower wall has a width of approximately 0.56 inch. The upper wall 302 has a width of approximately 0.85 inch and has a length of approximately 17.46 inches. Each end of the upper wall extends beyond the ends of the left side wall and the lower wall to form an extended portion 310. The extended portions of the upper wall are generally triangle but are rounded for appearance and to eliminate sharp edges.

Each end of the left roller bearing support 250 includes a generally rectangular end shim 320 comprising steel having a thickness of approximately 0.06 inch that extends approximately 0.34 inch from the bottom wall 304 toward the top wall 302 and that extends approximately 0.28 inch from the left side wall 300 toward the open portion of the U-shaped profile. The end shims are advantageously formed by bending an extended portion of the left side wall.

A generally rectangular notch 330 is removed from the edge of the bottom wall 304 opposite the left side wall 300. In the illustrated embodiment, the notch has a length along the left roller bearing support 250 of approximately 0.5 inch and has a depth into the bottom wall toward the left side wall of approximately 0.3 inch. The purpose of the notch is described below.

A pair of central side shims 332 are positioned on the edge of the bottom wall 304 on either side of the notch 330. The central side shims extend toward the top wall 302. Each central side shim has a width of approximately 0.3 inch, has a height of approximately 0.28 inch and has a thickness of approximately 0.6 inch. In the illustrated preferred embodiment, the central side shims are welded to the edge of the bottom wall after the left roller bearing support 250 is positioned on the left frame member 202. Preferably, a rear side shim 334 of like construction is welded to the bottom wall at the rear of the left roller bearing support. A front side shim (not shown) could also be attached to the bottom wall in a corresponding location at the front of the roller support; however, the front side shim is not required and is not included in the preferred embodiment.

The left roller bearing support 250 has a forwardmost hole 340, a first central hole 342, a second central hole 344 and a rearmost hole 346 formed in the left side wall 300. Each of the holes has a diameter of approximately 3/16 inch (0.187 inch). The centers of the first and second central holes are positioned approximately 1.55 inches from the longitudinal center of the left side wall. The centers of the forwardmost hole and the rearmost hole are positioned approximately 8.14 inches from the longitudinal center of the left side wall. The centers of the first and second central holes are positioned on a first centerline 350 that is horizontal and is approximately 0.12 inch from the surface of the bottom wall 304. The centers of the forwardmost hole and the rearmost hole are positioned on a second centerline 352 that is also horizontal and is approximately 0.12 inch from the surface of the top wall 302. Accordingly, the first centerline and the second centerline are parallel and are spaced apart by approximately 0.1 inch. A third centerline 354 passes through the center of second center hole and the rearmost hole and intersects the first centerline at the angle θ (e.g., approximately 0.9 degree).

As shown in FIG. 7, the two left roller bearing assemblies 260 are mounted on the left roller bearing support 250 by welding one of the nuts 272 to the left wall 300 so that the threaded central bore of the nut 272 is concentric to the rearmost hole 346 with the attached lock washer on the side of the nut facing away from the left wall. A second nut is welded to the left wall concentric to the second central hole 344. The forwardmost hole 340 and the first central hole 342 are not used on the left roller bearing support. A first axle 270 is inserted through the hub of the rear roller bearing assembly and the flat washers 274 and is secured to nut proximate the rearmost hole. A second axle is similarly inserted through the hub of the forward roller bearing assembly and flat washers and is secured to the nut proximate to the second central hole.

As discussed above, the right roller bearing support 252 is the mirror image of the left roller bearing support 250. Accordingly, only a single version of the roller bearing support has to be manufactured in accordance with the shape shown in FIGS. 8 and 9. The right roller bearing support is created by simply rotating the roller bearing support from the position shown in FIG. 8 and by attaching the nuts 272 to the forwardmost hole 340 and the first central hole 342, which are at the rear when the structure is rotated to the position of the right roller bearing support.

After securing the roller bearing assemblies 260 to the roller bearing supports 250, 252, the roller bearing supports are attached to the oven rack 110 by positioning the left frame member 202 into the U-shaped profile of the left roller bearing support and by positioning the right frame member 204 into the U-shaped profile of the right roller bearing support. Each roller bearing support is positioned with the longer top wall 302 facing upward and with the bearing assemblies mounted to the side walls 300 facing outward. Accordingly, the two bearing assemblies on each roller bearing support are closer to the rear frame member 208. The two empty holes on the side walls of each roller bearing support are closer to the front frame member 206.

After positioning the left roller bearing support 250 on the left frame member 202, the two central side shims 332 and the rear side shim 334 are welded to the bottom wall 304 of the left roller bearing support. The left roller bearing support is positioned on the left frame member so that the notch 330 of the bottom wall 304 is aligned with the central frame member 210 with the central frame member positioned between the two central side shims. The rear side shim is welded to the bottom wall of the left roller bearing support proximate to the rear frame member 208. Accordingly, the left roller bearing support is substantially constrained to pivot about the left frame member. The two central side shims and the rear side shim limit longitudinal movement along the left frame member. The two end shims 320 of the left roller bearing support limit radial movement away from the longitudinal axis of the left frame member.

The right roller bearing support 252 is installed on the right frame member 204 in a similar manner by welding the two central side shim members 332 and the rear side shim member 334 to the lower side wall 304 of the right roller bearing support after positioning the right roller bearing support with the notch 330 aligned with the central frame member 210 between the two central side shim members.

Figure 10:
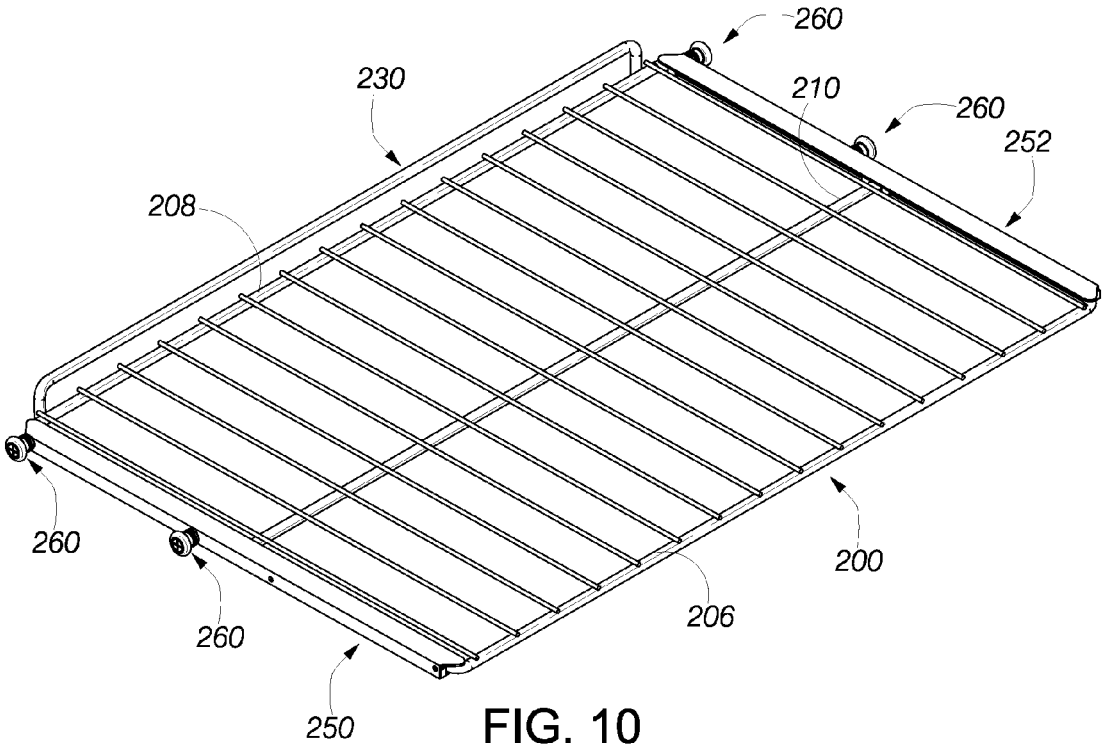
FIG. 10 illustrates a perspective view of the oven rack with the roller bearing supports pivoted to horizontal positions with respect to the plane of the oven rack to fully extend the roller bearings outward.
Figure 11:
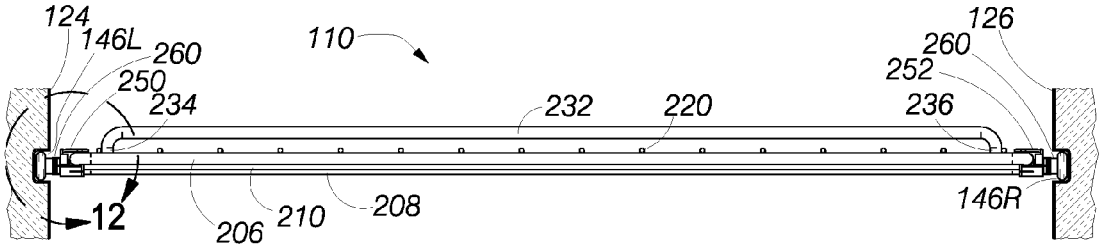
FIG. 11 illustrates a front elevation view of the oven rack of FIG. 10 with the roller bearings in fully extended positions and further showing a pair of opposing horizontal guide slots of the oven cavity in cross section with the roller bearings inserted in the guide slots.

The completed assembly of the oven rack 110 is shown in FIG. 10 with the roller bearing assemblies 260 fully extended on each side of the oven rack. As shown in FIGS. 11 and 12, the width of the frame 200 of the oven rack and the lengths of the roller bearing assemblies are selected so that the wheel 262 of each roller bearing assembly is inserted into one of the longitudinal guide slots (e.g., the lowermost longitudinal guide slots 146L and 146R) of the oven cavity 100. The wheel rests on the lower surface 174 of the respective guide slot. When the roller bearing assemblies are fully extended horizontally, the upper wall 302 of each roller bearing support 250, 252 rests on the central frame member 210, and the extended portions 310 of the upper wall of each roller bearing support rests on the front frame member 206 and the rear frame member 208. Thus, the roller bearing supports cannot pivot beyond the position shown. The weight of the oven rack and the weight of any cookware and food product on the oven rack are transferred to the roller assemblies via the roller bearing supports.

The outer diameter of the wheel 262 and height of the guide slots 146L, 146R are selected so that the wheel has very little clearance between the top of the wheel and the upper surface 172 of the guide slot. Accordingly, if a user places more weight toward the front of the oven rack 110, the oven rack will pivot by only a small amount before the top of the wheel engages the upper surface of the guide slot and prevents the oven rack from pivoting further. Since the front of the oven rack is initially angled upward with respect to the rear of the oven rack, the small amount of pivoting allowed by the clearance of the wheels is insufficient to allow the front of the oven rack to tilt downward to an unsafe angle.

When the oven rack 110 is positioned in the oven cavity 100 with the wheels 262 fully engaged with the guide slots (e.g., the lowermost guide slots 146L, 146R), the oven rack may be moved inward until the rearmost wheels engage the rearmost ends of the guide slots. The oven rack may be moved outward until the forwardmost wheels engage the forwardmost ends of the guide slots. Since the oven rack is moving on wheels rotating on ball bearings, the oven rack is easily moved between the forward and rear limits. Unlike conventional oven racks, which frictionally engage ledges within the oven cavity and require additional force to overcome the friction, the wheels reduce friction to such an extent that no jerking movements are required to overcome friction. Thus, all movements of loaded oven racks can be accomplished with little or no excessive acceleration that may disturb the food being prepared in the oven cavity. Accordingly, spillage of liquids, such as grease, is reduced.

Figure 13:
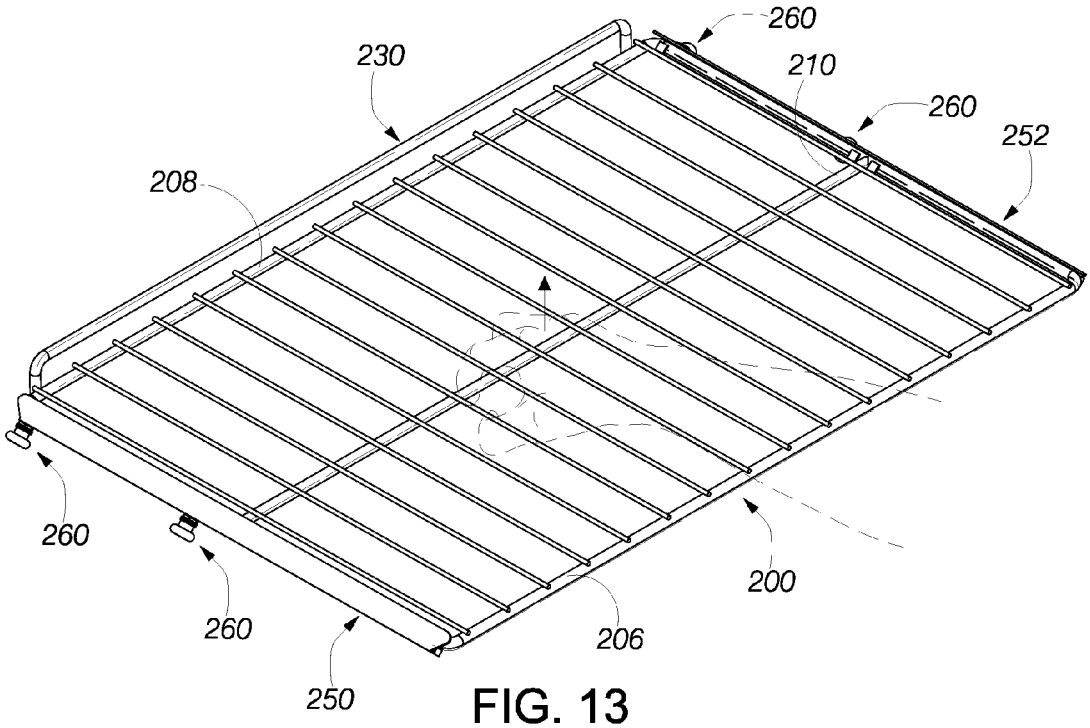
FIG. 13 illustrates a perspective view of the oven rack with the roller bearing supports on each side of the oven rack pivoted by approximately 45 degrees with respect to the plane of the oven rack as the oven rack is initially lifted to remove the oven rack from the oven cavity.
Figure 14:
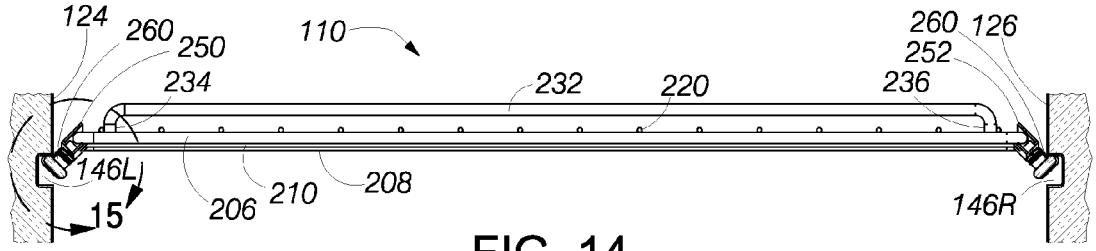
FIG. 14 illustrates a front elevation view of the oven rack of FIG. 13 similar to the view of FIG. 11 but with the roller bearing supports at each side pivoted to an angle of 45 degrees and with the roller bearings partially disengaged from the horizontal guide slots of the oven cavity.
Figure 15:
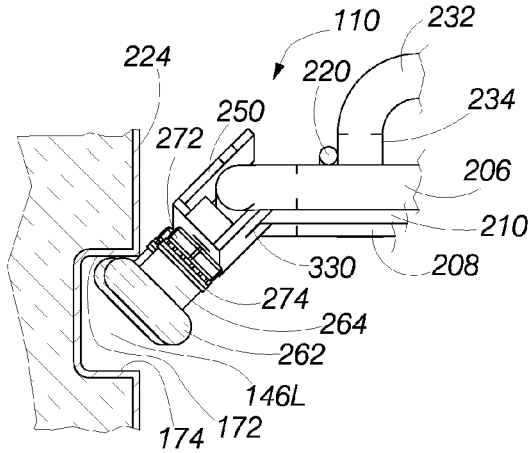
FIG. 15 illustrates an enlarged view of the left roller bearing and the left horizontal guide slot of the oven cavity in the area bounded by the arcuate line 15 in FIG. 14.

The oven rack 110 is easily removed from the oven cavity 100 for cleaning or for adjusting the height of the oven rack by moving the oven rack to a different pair of horizontal guide slots. As shown in FIGS. 13-15, when the user (shown in phantom) lifts the oven rack, the roller bearing assemblies 260 pivot about the left frame member 202 and the right frame member 204 because of the effect of gravity on the roller bearing assemblies and because the top surface 172 of each guide slot (e.g., the lower guide slots 146L, 146R) constrains the wheels 262 of the roller bearing assemblies from moving upward with the frame 200 of the oven rack.

Figure 16:
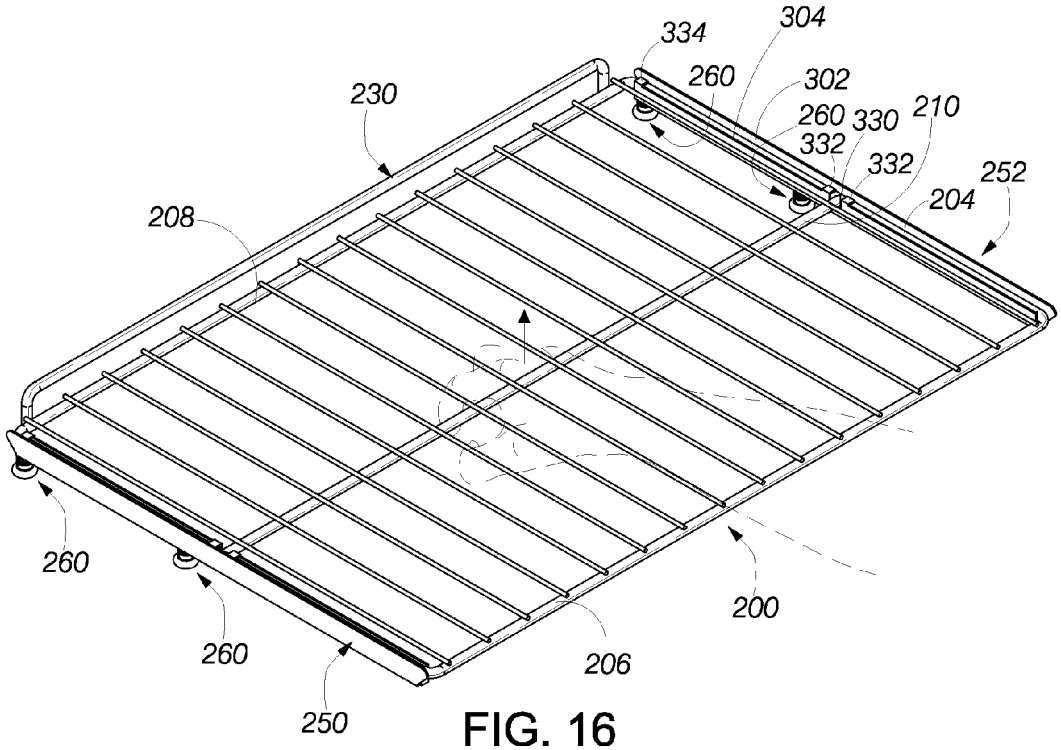
FIG. 16 illustrates a perspective view of the oven rack with the roller bearing supports on each side of the oven rack fully pivoted to a position substantially perpendicular to the plane of the oven rack.
Figure 17:
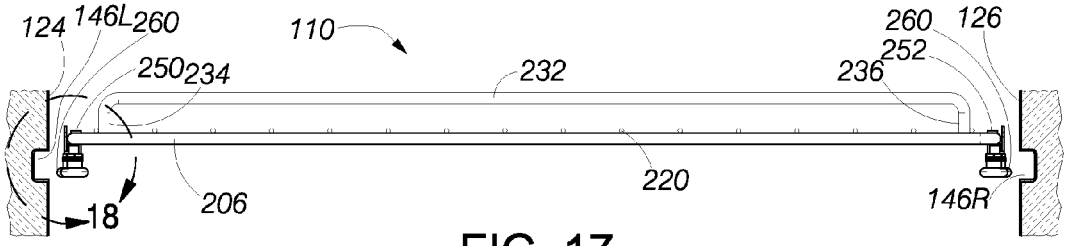
FIG. 17 illustrates a front elevation view of the oven rack of FIG. 16 similar to the view of FIGS. 11 and 14 but with the roller bearing supports at each side pivoted to a perpendicular (fully dropped) position and with the roller bearings entirely disengaged from the horizontal guide slots.
Figure 18:
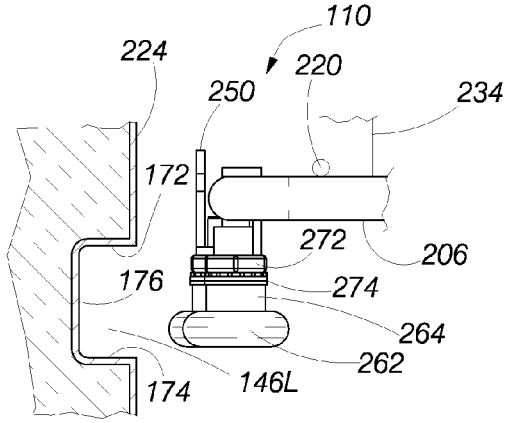
FIG. 18 illustrates an enlarged view of the left roller bearing and the left horizontal guide slot of the oven cavity in the area bounded by the arcuate line 18 in FIG. 17.

As shown in FIGS. 16-18, once the bottom of each wheel 262 clears the lower surface 174 of the respective guide slot (e.g., the lower guide slots 146L, 146R), the left roller bearing support 250 and the right roller bearing support 252 continue to pivot around the left frame member 202 and the right frame member 204. The bearing assemblies 260 pivot to generally perpendicular positions with respect to the frame 200 of the oven rack 110. As shown for the right roller bearing support in FIG. 15, the two central side shims 232 and the rear side shim 334 rest upon the right frame member and restrain the right roller bearing support on the right frame member. The left roller support is restrained on the left frame member in like manner. Since the wheels of the roller bearing assemblies are no longer constrained by the guide slots, the oven rack may be removed from the oven cavity 100 or may be moved vertically within the oven cavity to a new position.

The oven rack 110 is easily installed in a selected pair of horizontal guide slots (e.g., the guide slots 146L, 146R) by reversing the removal process. The oven rack is positioned generally horizontally within the oven cavity 100 with the wheels 262 of the bearing assemblies positioned proximate to an opposing pair of guide slots. The user then applies light pressure against the top wall 302 of each roller bearing support 250, 252 to cause the roller bearing assemblies to pivot outward and upward to engage the wheels with the respective guide slots. The procedure may be accomplished by first positioning the wheels on one side of the oven rack into the guide slot on one side of the oven cavity and then positioning the wheels on the other side of the oven rack into the guide slot on the other side of the oven cavity. It is also quite easy to pivot the wheels on both sides of the oven rack at the same time to engage the opposing guide slots in one operation.

As discussed above, the embodiment described herein is particularly advantageous because the guide slots 140L, 140R; 142L, 142R; 144L, 144R; 146L, 146R do not extend into the oven cavity 100. Accordingly, the entire width of the oven cavity is available to accommodate cookware. Furthermore, when the oven racks 110 are removed from the oven cavity, the left wall 124 and the right wall 126 of the oven cavity are easily cleaned since the guide slots are relatively large and easily accessible.

Although described above with respect to two symmetrically disposed hinged roller bearing supports 250, 252, it should be appreciated that in alternative embodiments one of the roller bearing supports may be fixed (non-pivoting) so that the attached roller bearing assemblies always extend outward from the oven rack 110 for engagement with the guide slots in the oven cavity 100. For example, the right roller bearing support may be fixed. In such an embodiment, the user first inserts the wheels 262 of the right roller assemblies 260 into the lowest right guide slot 146R, and then pivots the left roller bearing support, as described above, to insert the wheels of the left roller assemblies into the lowest left guide slot. In a further alternative embodiment, one of the roller assemblies on each roller bearing support may be replaced with a sliding element to fix the rear portion of the oven rack within the guide slots between the respective upper surface 172 and lower surface 174 of each guide slot.

One skilled in art will appreciate that the foregoing embodiments are illustrative of the present invention. The present invention can be advantageously incorporated into alternative embodiments while remaining within the spirit and scope of the present invention, as defined by the appended claims.

What is claimed is:

1. An oven rack comprising:

a generally rectangular frame that supports a generally planar platform capable of being supported in an oven for supporting food products, the frame including at least a first side frame member and a second side frame member;

a first roller support supported by and pivotal about the first side frame member, the first roller support having at least a first pivot position and a second pivot position, the first roller support extending outward from the first side frame member when the first roller support is in the first pivot position, the first roller support hanging freely from the first side frame member when the first roller support is in the second pivot position; and a first roller assembly mounted to the first roller support, the first roller assembly having a first rotational axis, the first rotational axis being positioned in a first plane generally parallel to the planar platform when the first roller support is in the first pivot position, the first rotational axis being positioned in a second plane at an angle with respect to the planar platform when the first roller support is in the second pivot position.

2. The oven rack as defined in claim 1, further comprising a second roller assembly mounted to the first roller support and spaced apart from the first roller assembly, the second roller assembly having a second rotational axis, the second rotational axis being positioned in a third plane generally parallel to the planar platform when the first roller support is in the first pivot position, the second rotational axis being positioned in a fourth plane at an angle with respect to the planar platform when the first roller support is in the second pivot position.

3. The oven rack as defined in claim 2, wherein the third plane is parallel to the first plane and wherein the fourth plane is parallel to the second plane.

4. The oven rack as defined in claim 3, wherein the third plane is displaced from the first plane.

5. The oven rack as defined in claim 1, further comprising:

a second roller support supported by and pivotal about the second side frame member, the second roller support having at least a respective first pivot position and a respective second pivot position, the second roller support extending outward from the second side frame member when the second roller support is in the respective first pivot position, the second roller support hanging freely from the second side frame member when the second roller support is in the respective second pivot position; and a respective first roller assembly mounted to the second roller support, the respective first roller assembly of the second roller support having a respective first rotational axis, the respective first rotational axis of the respective first roller assembly of the second roller support being positioned in the first plane generally parallel to the planar platform when the second roller support is in the respective first pivot position, the respective first rotational axis of the respective first roller assembly of the second roller support being positioned in a respective second plane at an angle with respect to the planar platform when the second roller support is in the respective second pivot position.

6. The oven rack as defined in claim 5, wherein the second roller support further comprises a respective second roller assembly having a respective second rotational axis.

7. An oven rack comprising:

a generally rectangular frame that supports a plurality of support members that form a generally planar platform capable of being supported in an oven for supporting food products, the frame including at least a left frame member and a right frame member;

a left roller support supported by and pivotal about the left frame member, the left roller support having at least a first left pivot position and a second left pivot position, the left roller support extending outward from the left side frame member when the left roller support is in the first left pivot position, the left roller support hanging freely from the left frame member when the left roller support is in the second left pivot position;

a right roller support supported by and pivotal about the right frame member, the right roller support having at least a first right pivot position and a second right pivot position, the right roller support extending outward from the right side frame member when the right roller support is in the first right pivot position, the right roller support hanging freely from the right frame member when the right roller support is in the second right pivot position;

a first left roller assembly and a second left roller assembly mounted to the left roller support, each left roller assembly having a respective rotational axis, the rotational axes being generally parallel to the planar platform when the left roller support is in the first left pivot position, the rotational axes being at an angle with respect to the planar platform when the left roller support is in the second left pivot position; and a first right roller assembly and a second right roller assembly mounted to the right roller support, each right roller assembly having a respective rotational axis, the rotational axes being generally parallel to the planar platform when the right roller support is in the first right pivot position, the rotational axes being at an angle with respect to the planar platform when right roller support is in the second right pivot position.

8. The oven rack as defined in claim 7, wherein:

the peripheral frame includes a rear frame member and a front frame member;

the left roller support is mounted on the left frame member with a first end proximate the rear frame member and with a second end proximate the front frame member;

the first left roller assembly is mounted on the left roller support proximate the first end of the left roller support;

the second left roller assembly is mounted on the left roller support between the first roller assembly and the second end of the left roller support;

the right roller support is mounted on the right frame member with a first end proximate the rear frame member and with a second end proximate the front frame member;

the first right roller assembly is mounted on the right roller support proximate the first end of the right roller support; and the second right roller assembly is mounted on the right roller support between the first roller assembly and the second end of the right roller support.

9. The oven rack as defined in claim 8, wherein:

the left roller support has a midpoint;

the second left roller assembly is mounted on the left roller support between the first end of the left roller support and the midpoint of the left roller support; and the second right roller assembly is mounted on the right roller support between the first end of the right roller support and the midpoint of the right roller support.

10. The oven rack as defined in claim 7, wherein:

the frame includes at least one transverse frame member having a first end attached to the left frame member and a second end attached to the right frame member;

the left roller support comprises a generally U-shaped member having a side wall, an upper wall and a lower wall, the left roller support positioned on the left frame member with the left frame member between the upper wall and the lower wall;

the first and second left roller assemblies are mounted to the side wall of the left roller support;

the upper wall of the left roller support engages the transverse frame member when the left roller support is pivoted to the first left pivot position; and the lower wall of the left roller support includes a notch having a front boundary and a rear boundary, the front boundary and the rear boundary of the notch spaced apart to enable the transverse frame member to pass between the front boundary and the rear boundary of the notch when the left roller support is pivoted to the second left pivot position.

11. The oven rack as defined in claim 7, wherein:

the frame comprises a front frame member and a rear frame member;

the left roller support comprises a generally U-shaped member having a side wall, an upper wall and a lower wall, the left roller support positioned on the left frame member with the left frame member between the upper wall and the lower wall; and the upper wall of the left roller support has a first end and a second end, at least one of the first end and the second end of the left roller support engaging at least one of the front frame member and the rear frame member when the left roller support is pivoted to the first left pivot position.

12. The oven rack as defined in claim 7, wherein:

the frame comprises a front frame member and a rear frame member;

the right roller support comprises a generally U-shaped member having a side wall, an upper wall and a lower wall, the right roller support positioned on the right frame member with the right frame member between the upper wall and the lower wall; and the upper wall of the right roller support has a first end and a second end, at least one of the first end and the second end of the right roller support engaging at least one of the front frame member and the rear frame member when the right roller support is pivoted to the first right pivot position.

13. The oven rack as defined in claim 7, wherein:

the rectangular frame further comprises a front frame member, a rear frame member and a central frame member;

the central frame member has a first end and a second end;

the first end of the central frame member is attached to the left frame member at a location between the front frame member and the rear frame member;

the second end of the central frame member is attached to the right frame member at a location between the front frame member and the rear frame member;

the left roller support engages the central frame member when the left roller support is pivoted to the first left pivot position; and the right roller support engages the central frame member when the right roller support is pivoted to the first right pivot position.

14. An oven rack comprising:

a generally rectangular frame that supports a generally planar platform capable of being supported in an oven for supporting food products, the frame including at least a first side frame member and a second side frame member;

a first roller support supported by and pivotal about the first side frame member, the first roller support having at least an upper pivot position and a lower pivot position, the first roller support extending outward from the first side frame member when the first roller support is in the upper pivot position, the first roller support hanging loosely from the first side frame member when in the lower pivot position, the first roller support including an extended portion that engages the rectangular frame to preclude pivotal movement of the first roller support upward past the upper pivot position; and a first roller assembly mounted to the first roller support, the first roller assembly having a first rotational axis, the first rotational axis being positioned in a first plane generally parallel to the planar platform when the first roller support is in the upper pivot position, the first rotational axis being positioned in a second plane at an angle with respect to the planar platform when the first roller support pivots to the lower pivot position.

15. The oven rack as defined in claim 14, further comprising:

a second roller support supported by and pivotal about the second side frame member, the second roller support having at least a respective upper pivot position and a respective lower pivot position, the second roller support extending outward from the second side frame member when the second roller support is in the upper pivot position, the second roller support hanging loosely from the second side frame member when in the respective lower pivot position, the second roller support including an extended portion that engages the rectangular frame to preclude pivotal movement of the second roller support upward past the respective upper pivot position; and a second roller assembly mounted to the second roller support, the second roller assembly having a respective first rotational axis, the respective first rotational axis of the second roller assembly being positioned in a respective first plane generally parallel to the planar platform when the second roller support is in the respective upper pivot position, the second rotational axis being positioned in a respective second plane at an angle with respect to the planar platform when the second roller support pivots to the respective lower pivot position.

* * * * *